US006161898A

United States Patent [19]

Brevi

[11] Patent Number: 6,161,898

[45] Date of Patent: Dec. 19, 2000

[54] ADJUSTABLE HIGHCHAIR

[75] Inventor: Mauro Brevi, Bergamo, Italy

[73] Assignee: Brevi S.r.l., Telgate, Italy

[21] Appl. No.: 09/122,695

[22] Filed: Jul. 27, 1998

[30] Foreign Application Priority Data

Aug. 19, 1997 [IT] Italy ..... MI97A1948

[51] Int. Cl.[7] ..... A47C 1/02

[52] U.S. Cl. ..... 297/328; 297/16.1; 297/150; 297/344.14

[58] Field of Search ..... 297/344.12, 344.13, 297/344.14, 344.18, 327, 328, 16.1, 24, 150

[56] References Cited

U.S. PATENT DOCUMENTS 4,722,570 2/1988 Bertoli .
5,165,755 11/1992 Rho .
5,445,432 8/1995 Chien .
5,468,051 11/1995 Huang .
5,507,550 4/1996 Maloney .
5,509,719 4/1996 Cone, II .
5,558,400 9/1996 Poulson et al. .
5,669,664 9/1997 Perego .
5,707,104 1/1998 Perego .
5,951,102 9/1999 Poulson et al. .

FOREIGN PATENT DOCUMENTS 3304443 8/1984 Germany .

*Primary Examiner*—Milton Nelson, Jr.
*Attorney, Agent, or Firm*—Guido Modiano; Albert Josif; Daniel O'Byrne

[57] ABSTRACT

An adjustable highchair, comprising a seat which is associated with a frame by virtue of seat position adjustment elements, characterized in that the seat position adjustment elements comprise actuation elements which are arranged in an upward region of the seat which can be accessed easily.

21 Claims, 4 Drawing Sheets

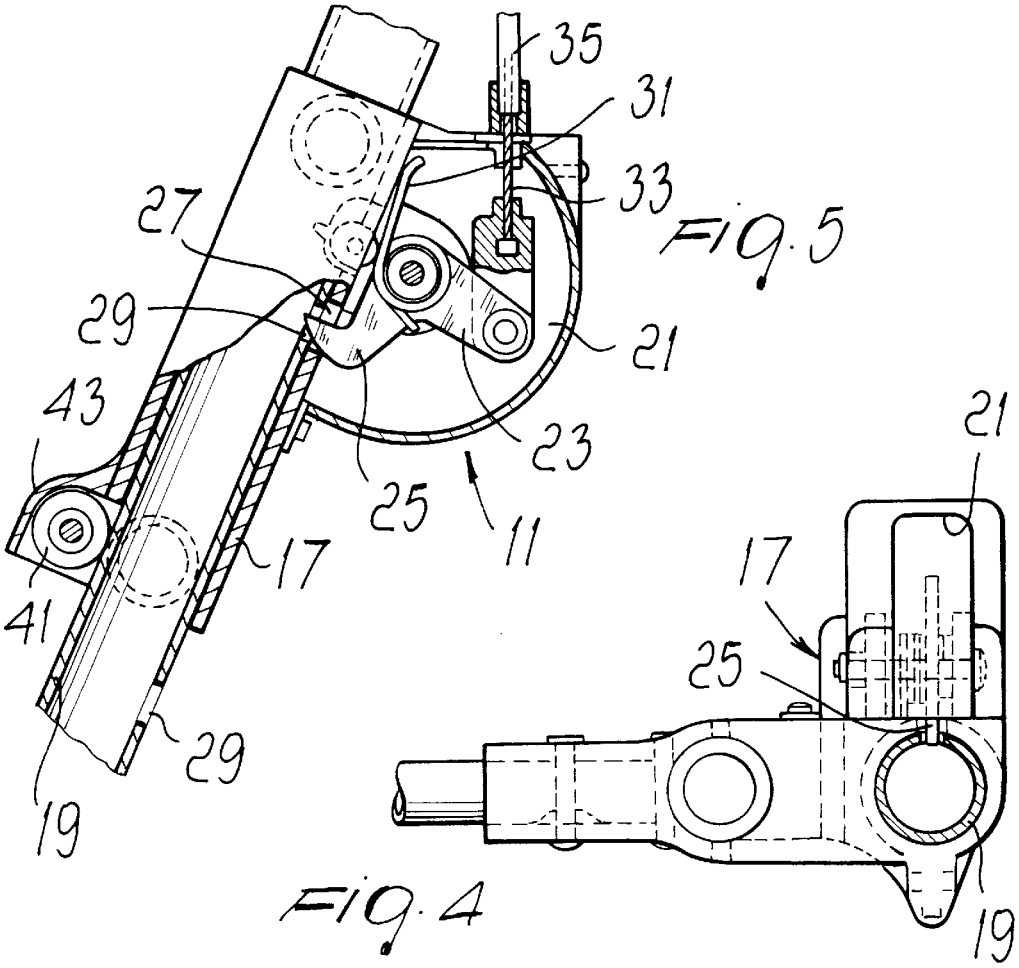
Fig. 5
Fig. 4
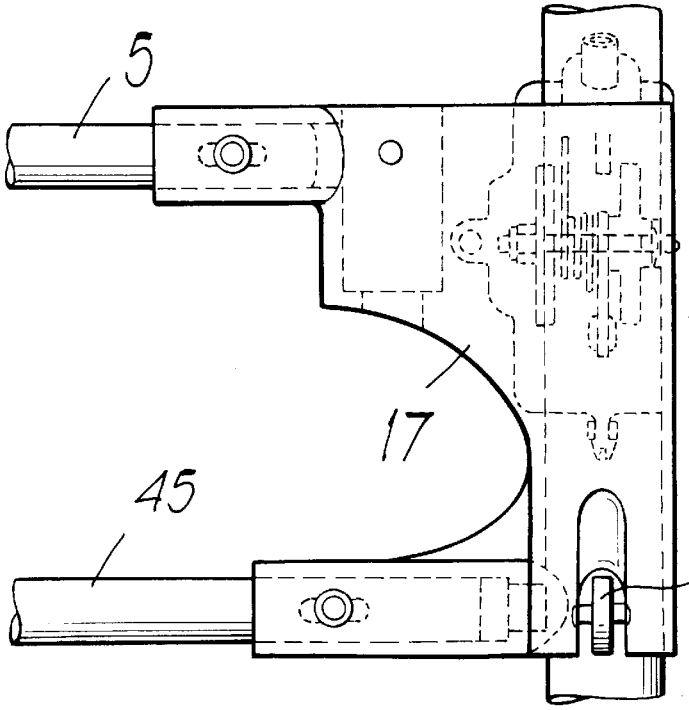
Fig. 6

ADJUSTABLE HIGHCHAIR

BACKGROUND OF THE INVENTION

The present invention relates to an adjustable highchair.

Adjustable highchairs for children are commercially known which allow to adjust the height and inclination of the seat as required.

However, adjusting the position of the seat is not always easy and requires a certain effort on the part of the adult, who sometimes is an elderly person. A certain skill is also required to operate the adjustment mechanisms, the operation whereof is not always easy.

SUMMARY OF THE INVENTION

The aim of the present invention is to provide an adjustable highchair which is simpler and quicker to adjust than conventional highchairs.

Within this aim, an object of the invention is to provide a highchair which allows to adjust the height of the seat by acting only on the seat itself.

A particular object of the invention is to provide a highchair which allows to adjust the position of the seat without forcing the user to bend or in any case perform particular efforts.

Another object of the invention is to provide a highchair in which the operation of the means for adjusting the position of the seat is immediately understandable.

Another object is to provide a highchair which is structurally strong and at the same time lightweight and easy to fold.

This aim, these objects and others which will become apparent hereinafter are achieved by an adjustable highchair, comprising a seat which is associated with a frame through seat position adjustment means, characterized in that said seat position adjustment means comprise actuation means which are arranged in an upward region of said seat which can be accessed easily.

BRIEF DESCRIPTION OF THE DRAWINGS

Further characteristics and advantages of the invention will become apparent from the description of a preferred but not exclusive embodiment of the invention, illustrated only by way of non-limitative example in the accompanying drawings, wherein:

FIG. 4 is a sectional enlarged-scale side elevation view of the detail of the means for adjusting the height of the seat;

FIG. 5 is a partially sectional plan view of the detail of FIG. 4;

FIG. 6 is a front view of the detail of FIG. 4;

DESCRIPTION OF THE PREFERRED EMBODIMENTS

Figure 1:
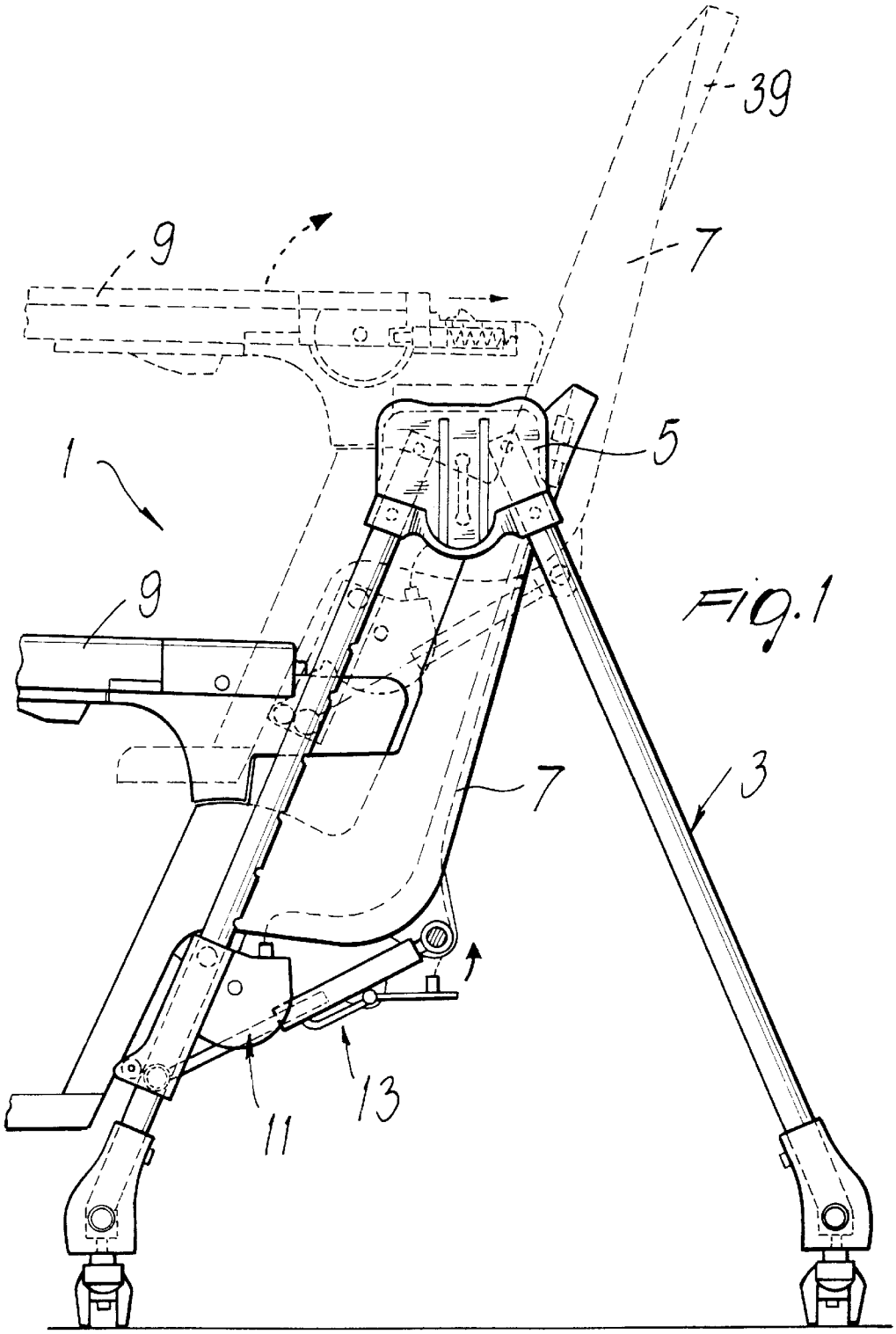
FIG. 1 is a side elevation view of an adjustable highchair according to the invention in the open position.
Figure 2:
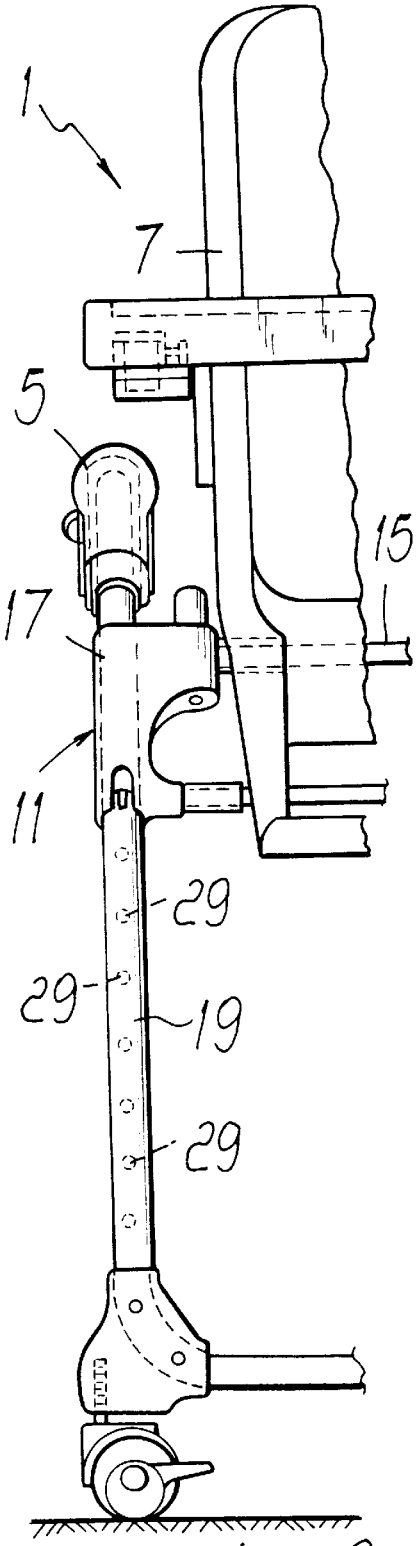
FIG. 2 is a partial front elevation view of the adjustable highchair according to the invention, in the open position.
Figure 3:
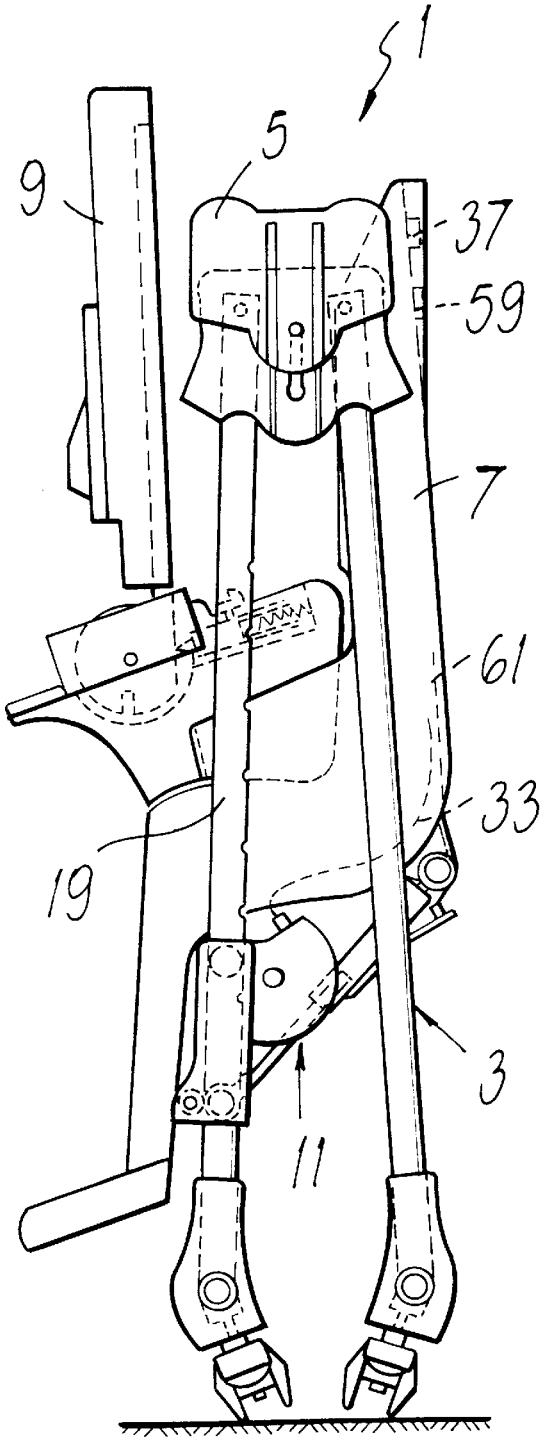
FIG. 3 is a side elevation view of the adjustable highchair according to the invention, in the closed or folded position.

With reference to the above figures, the adjustable highchair according to the invention, generally designated by the reference numeral 1, comprises a folding articulated frame 3 provided with an articulation 5 which can be locked in at least one open position (FIG. 1) and at least one closed or folded position (FIG. 3).

The frame 3 supports a seat 7, which is advantageously provided with armrests 9 which are adapted to support an optional surface or tray (not shown). The seat 7 is associated with the frame 3 through means 11 for adjusting the height of the seat from the ground and means 13 for adjusting the inclination of the seat.

The seat 7 is pivoted to a horizontal supporting bar 15 which is in turn associated with sliding blocks 17 which are adapted to slide along the front legs 19 of the frame. Each sliding block 17 comprises a chamber 21 for accommodating a lever 23 which comprises a hook 25 which is adapted to protrude from a hole 27 and to engage a hole 29 of a plurality of holes 29 formed along the leg 19 of the frame.

The hook 25 is normally kept in the locking position, i.e., in the position for engaging the hole 29, by a spring 31. In order to disengage the hook from the hole disengagement means are provided which are constituted by a cable 33 slideable in a sheath 35. A first end of said cable is fixed to the lever 23 and a second end of said cable is associated with an actuation button 37, advantageously associated with the back 39 of the seat 7 in a position which is handy for actuation on the part of an adult.

The sliding block also comprises a wheel 41 which is slideable on the front part of the leg 19 and is protected by a housing 43. The wheel 41 facilitates the sliding of the sliding block along the leg 19, avoiding any jamming.

A spacer 45 connects the two sliding blocks 17 in order to strengthen the structure.

The means 13 for adjusting the inclination of the seat comprise a telescopic element 47 provided with an internal bar 49 which is associated with the sliding blocks 17 or with the spacer 45 and is slideable within a hollow bar 51, which is in turn associated with the seat 7. A hook-shaped lever 53 is associated with the hollow bar 51 and is adapted to engage, by means of a spring 55, one of a series of seats 57 formed along the internal bar 49, so that by selecting the seat that is engaged it is possible to vary the useful length of the telescopic element 47 and accordingly the inclination of the seat 7 with respect to the frame 3, as shown more clearly in FIG. 8.

The hook-shaped lever 53 can advantageously be actuated by means of a button 59 which is associated with the hook-shaped lever 53 by means of a sheathed cable 61 which is similar to the cable 33. In this manner, the inclination of the seat 7 can be changed easily by gripping the back 39 and acting on the button 59 to release the hook-shaped lever 53, allowing the elongation or retraction of the telescopic element 47.

Figures 7, 8:
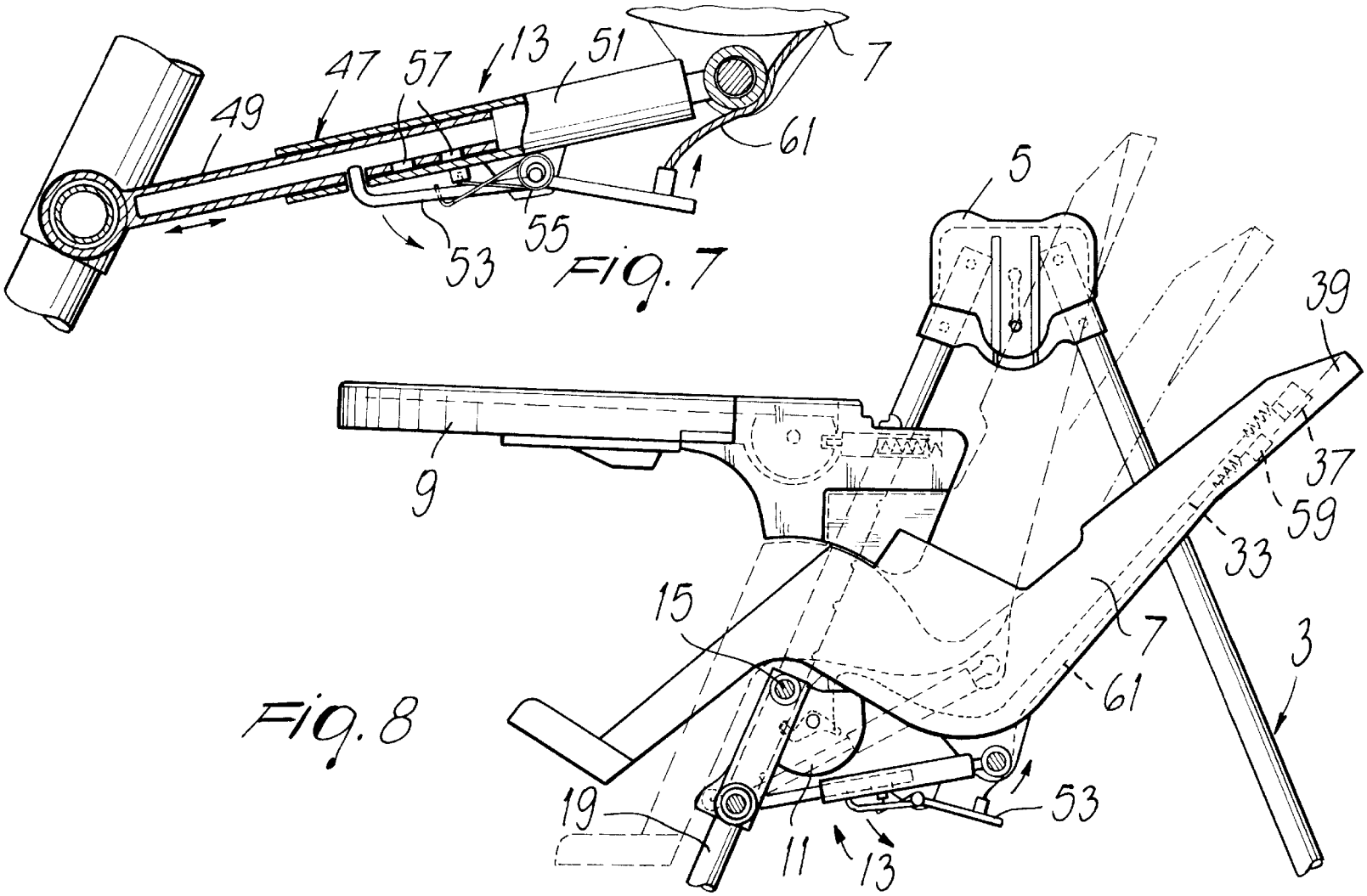
FIG. 7 is a partially sectional enlarged-scale side elevation view of the detail of the means for adjusting the inclination of the seat.
FIG. 8 is a partial view, similar to FIG. 1, of the seat showing different inclinations.

As shown more clearly in FIG. 3, the highchair 1 can be easily folded for transport or when not in use simply by acting on the articulation 5 and closing the legs of the frame. The armrests 9 can of course be folded as well. It is also noted that the armrests 9, during use of the highchair, remain horizontal at all times regardless of the inclination of the seat 7, as shown in FIG. 8.

During the use of the highchair, the height of the seat from the ground can be changed very easily by means of the buttons 37, which are advantageously arranged on the rear part and optionally on the lateral part of the back 39 of the seat 7, so that an adult can simply grip the seat without bending down, act on the buttons 37 and adjust the height of said seat.

In practice it has been found that the invention achieves the intended aim and objects, an adjustable highchair having been provided which has means for adjusting the height of the seat and its inclination which make said adjustments very quick and easy.

It is evident that the presence of the actuation buttons on the back of the seat allows to adjust the position of the seat without forcing the adult to bend down and drastically reduces the effort required. The actuation of the buttons is furthermore self-evident and requires no particular skill on the part of the user, who merely has to grip the back with his hands and, whilst pressing the buttons for example with his thumbs, move the seat into the chosen position.

The adjustable highchair according to the invention is susceptible of numerous modifications and variations, all of which are within the scope of the inventive concept; all the details may furthermore be replaced with technically equivalent elements.

The materials employed, as well as the dimensions, may of course be any according to requirements and to the state of the art.

The disclosures in Italian Patent Application No. MI97A001948 from which this application claims priority are incorporated herein by reference.

What is claimed is:

1. An adjustable highchair, comprising a seat which is connected to a frame through seat position adjustment means, wherein said seat position adjustment means comprise actuation means which are arranged in an upward region of said seat which can be accessed easily, said seat position adjustment means comprising means for adjusting the inclination of the seat, said actuation means comprising a button which is associated, by means of a sheathed cable, with said means for adjusting the inclination of the seat.

2. The adjustable highchair according to claim 1, wherein said frame comprises at least two pairs of legs which are mutually pivoted by means of two articulations in order to allow opening of said legs to use said highchair or the closure of said legs in order to reduce the overall dimensions of said frame.

3. The adjustable highchair according to claim 1, wherein said actuation means are arranged on a back region of the seat.

4. The adjustable highchair according to claim 3, wherein said actuation means are arranged on the rear of the back of said seat.

5. The adjustable highchair according to claim 1, wherein said seat position adjustment means comprise means for adjusting the height of the seat from the ground.

6. The adjustable highchair according to claim 5, wherein said actuation means comprise at least one botton.

7. The adjustable highchair according to claim 6, wherein said actuation means comprise two buttons which are associated, by means of respective sheathed cables, with said means for adjusting the height of the seat from the ground.

8. The adjustable highchair according to claim 1, wherein said means for adjusting the height of the seat from the ground comprise sliding blocks which are slideable along legs of said frame, each sliding block comprising a lever provided with a hook which is adapted to engage a hole of a plurality of holes formed along the leg of the frame, said hook being normally kept in the position for engaging one of said holes by an elastic element, said cable that can slide in a sheath having a first end which is fixed to said lever and a second end which is associated with one of said actuation buttons.

9. The adjustable highchair according to claim 8, wherein each of said sliding blocks also comprises a wheel which can slide on the front part of the leg to prevent jamming.

10. The adjustable highchair according to claim 8, wherein a spacer connects two of said sliding blocks which are slideable on respective legs of said frame.

11. The adjustable highchair according to claim 8, wherein said means for adjusting the inclination of the seat comprise a telescopic element which is provided with an internal hollow bar, associated with said sliding blocks, which is slideable inside a hollow bar which is in turn associated with said seat; a hook-shaped lever being associated with said hollow bar and being adapted to engage, by means of an elastic element, one of a series of seats formed along said hollow bar, so that by selecting the seat that is engaged a useful length of the telescopic element and therefore the inclination of the seat with respect to the frame can be varied.

12. The adjustable highchair according to claim 11, wherein said hook-shaped lever can be actuated by means of a said actuation button associated with said hook-shaped lever by means of a sheathed cable.

13. An adjustable highchair, comprising a seat which is connected to a frame through seat position adjustment means, wherein said seat position adjustment means comprise actuation means which are arranged in an upward region of said seat which can be accessed easily, said seat position adjustment means comprising means for adjusting the inclination of the seat and means for adjusting the height of the seat from the ground, said actuation means comprising two buttons which are associated, by means of respective sheathed cables, with said means for adjusting the height of the seat from the ground, said actuation means being arranged on a back region of the seat.

14. The adjustable highchair according to claim 13, wherein said actuation means are arranged on the rear of the back of said seat.

15. The adjustable highchair according to claim 13, wherein said frame comprises at least two pairs of legs which are mutually pivoted by means of two articulations in order to allow opening of said legs to use said highchair or the closure of said legs in order to reduce the overall dimensions of said frame.

16. The adjustable highchair according to claim 13, wherein said actuation means comprise a button which is associated, by means of a sheathed cable, with said means for adjusting the inclination of the seat.

17. The adjustable highchair according to claim 16, wherein each of said sliding blocks also comprises a wheel which can slide on the front part of the leg to prevent jamming.

18. The adjustable highchair according to claim 16, wherein a spacer connects two of said sliding blocks which are slideable on respective legs of said frame.

19. The adjustable highchair according to claim 13, wherein said means for adjusting the height of the seat from the ground comprise sliding blocks which are slideable along legs of said frame, each sliding block comprising a lever provided with a hook which is adapted to engage a hole of a plurality of holes formed along the leg of the frame, said hook being normally kept in the position for engaging one of said holes by an elastic element, said cable that can slide in a sheath having a first end which is fixed to said lever and a second end which is associated with one of said actuation buttons.

20. The adjustable highchair according to claim 19, wherein said means for adjusting the inclination of the seat comprise a telescopic element which is provided with an internal hollow bar, associated with said sliding blocks, which is slideable inside a hollow bar which is in turn associated with said seat; a hook-shaped lever being associated with said hollow bar and being adapted to engage, by means of an elastic element, one of a series of seats formed along said hollow bar, so that by selecting the seat that is engaged a useful length of the telescopic element and therefore the inclination of the seat with respect to the frame can be varied.

21. The adjustable highchair according to claim 20, wherein said hook-shaped lever can be actuated by means of a said actuation button associated with said hook-shaped lever by means of a sheathed cable.

* * * * *